US008556071B2

(12) United States Patent
Holloway et al.

(10) Patent No.: US 8,556,071 B2
(45) Date of Patent: Oct. 15, 2013

(54) PACKAGE FOR TOBACCO-RELATED ARTICLES

(75) Inventors: Steve Holloway, Slough (GB); Tim Collins, London (GB); Solvey Knorr, Hamburg (DE); Neil Southey, Slough (GB); Regine Wolfgramm, Hamburg (DE); Inga Gurke, Hamburg (DE); Guillaume Devivier, Les Aubrais (FR)

(73) Assignee: Imperial Tobacco Limited (GB)

( * ) Notice: Subject to any disclaimer, the term of this patent is extended or adjusted under 35 U.S.C. 154(b) by 0 days.

(21) Appl. No.: 13/510,774

(22) PCT Filed: Nov. 18, 2010

(86) PCT No.: PCT/EP2010/007008

§ 371 (c)(1),
(2), (4) Date: Jun. 27, 2012

(87) PCT Pub. No.: WO2011/060931

PCT Pub. Date: May 26, 2011

(65) Prior Publication Data

US 2012/0261286 A1 Oct. 18, 2012

(30) Foreign Application Priority Data

Nov. 20, 2009 (EP) ..... 09014501

(51) Int. Cl.
*B65D 85/10* (2006.01)

(52) U.S. Cl.
USPC ..... 206/250; 206/265

(58) Field of Classification Search
USPC ..... 206/265, 268, 242, 266, 271, 273, 249, 206/250, 254, 255
See application file for complete search history.

(56) References Cited

U.S. PATENT DOCUMENTS 1,185,560 A 5/1916 Walcutt
2,353,761 A * 7/1944 Ringler ..... 229/101

(Continued)

FOREIGN PATENT DOCUMENTS

EP 2033900 A1 3/2009
FR 1081649 12/1954

(Continued)

OTHER PUBLICATIONS

Written Opinion and Search Report for counterpart Singapore Application No. 201203082-1 entitled Package for Tobacco-Related Articles (Dated Nov. 8, 2012) (as issued by the Austrian Patent Office).

*Primary Examiner* — Jacob K Ackun
(74) *Attorney, Agent, or Firm* — Hovey Williams LLP

(57) ABSTRACT

A package for tobacco-related articles comprises a shell including a front wall, a rear wall, two lateral walls, and a top side. A lid is adapted to close the top side of the shell when in a closed state. The lid is swivelably connected to the rear wall or one of the lateral walls at a hinge line and is swivelable about the hinge line for transfer between the closed state and an opened state. The lid comprises a top wall including a front edge, a rear edge, two lateral edges, and a bottom side and is adapted to close the top side of the shell when the lid is in its closed state. A beveled edge wall extends from at least the edge of the top wall of the lid opposite to the hinge line and fits into the shell when the lid is in its closed state.

29 Claims, 7 Drawing Sheets

(56) References Cited

U.S. PATENT DOCUMENTS

Figure 1:
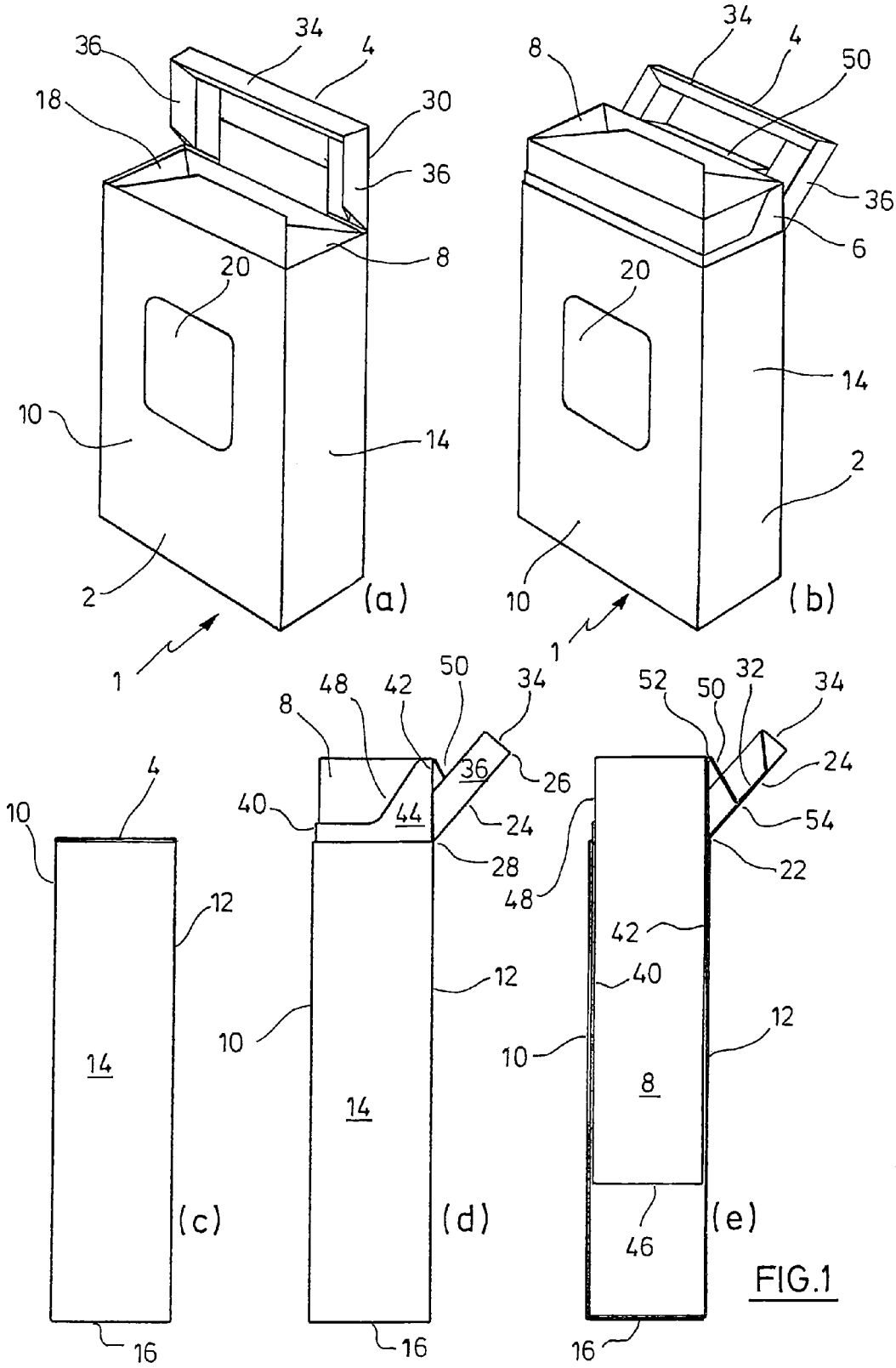

| | | | | | |
|---|---|---|---|---|---|
| 2,859,865 | A | * | 11/1958 | Williams | 206/259 |
| 2,865,498 | A | * | 12/1958 | Ringler | 206/268 |
| 2,940,590 | A | * | 6/1960 | Hook | 206/264 |
| 3,019,892 | A | * | 2/1962 | Jobst | 206/267 |
| 3,090,541 | A | * | 5/1963 | Frantisek | 206/264 |
| 3,105,591 | A | * | 10/1963 | Ahlbor | 206/264 |
| 3,223,275 | A | * | 12/1965 | Rice, Jr. | 220/324 |
| 3,899,125 | A | | 8/1975 | Andrews et al. | |
| 4,729,508 | A | | 3/1988 | Erdmann et al. | |
| 4,763,832 | A | | 8/1988 | Forbes, Jr. | |
| 4,848,648 | A | | 7/1989 | Eisman | |
| 5,921,384 | A | | 7/1999 | Focke et al. | |
| 2004/0031706 | A1 | * | 2/2004 | Stringfield | 206/268 |
| 2008/0128301 | A1 | * | 6/2008 | Bourgoin et al. | 206/268 |

FOREIGN PATENT DOCUMENTS

| | | | |
|---|---|---|---|
| GB | 388971 | | 3/1933 |
| WO | 9301095 | A1 | 1/1993 |

* cited by examiner

PACKAGE FOR TOBACCO-RELATED ARTICLES

RELATED APPLICATION

This is a National Phase Application pursuant to 35 U.S.C. §371 of International Application No. PCT/EP2010/007008, filed Nov. 18, 2010, claiming priority from European Patent Application No. EP 09014501.2, filed Nov. 20, 2009, the entire disclosures of both of which are hereby incorporated by reference herein.

BACKGROUND

The invention relates to a package for tobacco-related articles, e.g. for cigarettes or for cigarillos.

A conventional package for tobacco-related articles comprises a shell having a front wall, a rear wall, two lateral walls opposite to each other and a bottom wall connecting the front wall and the rear wall. The top side of the shell is closed by a lid, which can be opened by swiveling or rotating it about a hinge line provided at the rear wall or one of the lateral walls of the shell. Usually, the lid comprises a top wall and side walls, the side walls of the lid overlapping with some wall portions of the shell when the lid is closed. For opening or closing such package, the user generally has to apply both of his or her hands. This kind of package is shown in, e.g., U.S. Pat. No. 4,729,508. Its design is conventional and less appealing.

SUMMARY

It is the object of the invention to provide an attractive and moderate-priced package for tobacco-related articles which can be handled in a convenient way, optionally by means of one hand.

This problem is solved by a package for tobacco-related articles having the features described below.

The package according to the invention is designed to accommodate tobacco-related articles. The package comprises a shell having a front wall, a rear wall, two lateral walls opposite to each other and optionally a bottom wall, which connect the front wall and the rear wall, as well as a top side. A lid is adapted to close the top side of the shell when it is in a closed state. The lid is swivelably connected to the rear wall or one of the lateral walls of the shell at a hinge line, and it can be swiveled about this hinge line for transfer from the closed state to an opened state. The lid comprises a top wall having a front edge, a rear edge, two lateral edges and a bottom side. This top wall is adapted to close the top side of the shell when the lid is in its closed state.

Moreover, a bevelled edge wall extends from at least the edge of the top wall opposite to the hinge line of the lid, which bevelled edge wall fits into the shell when the lid is in its closed state.

When the lid is in its closed state, the bevelled edge wall is accommodated in the shell and generally not visible. Thus, the lid essentially appears as a flat top closure of the package, in contrast to a conventional package in which the lid exhibits a side wall on the side opposite to its hinge line. The package according to the invention provides to the user an appealing and attractive design.

Moreover, in spite of its "flatness", the lid is rigid because it is strengthened by the bevelled edge wall. In its closed state, the lid also strengthens the upper part of the package with respect to distortion. Due to its bevelled shape, the edge wall fits well into the shell during the closing procedure. Thus, it facilitates the closing process by guiding the lid into the top side space of the outer shell, stabilises the package when it is closed, and provides a better protection for the contents of the package.

In advantageous embodiments of the invention, the hinge line of the lid is located at the rear edge or at one of the lateral edges of the top wall, which enhances the overall impression of the lid in terms of its "flatness". The bevelled edge wall can also extend from other edges of the top wall of the lid different from the edge comprising the hinge line. For example, the bevelled edge wall may extend from all edges of the top wall of the lid, except for the edge comprising the hinge line. This provides to the lid a high overall strength and does not affect the "flatness" effect of the lid in its closed state and does not interfere with an easy closing procedure.

In alternative embodiments, the lid comprises a rear wall or a lateral wall extending from the rear edge or one of the lateral edges, respectively, of the top wall, and the hinge line of the lid is located at the free end of this rear wall or lateral wall. Such rear wall or lateral wall does not significantly reduce the "flatness" effect of the lid, which is dominated by the appearance at the edge opposite to the hinge line. On the other hand, this wall provides a lever having its pivot at the hinge line of the lid and facilitating the opening procedure. For example, the user can take the package in her or his hand, the wall having the hinge line of the lid facing the hand's palm, and grasp the top side of the lid by the thumb. When the thumb is moved towards the palm and is pressed slightly downwardly, the lid opens. Optionally the lid comprises at least one additional edge wall other than the bevelled edge wall opposite to the hinge line of the lid. For example; the lid may include a bevelled edge wall extending along all edges of the top wall of the lid, except for the edge from which the rear or lateral wall ending with the hinge line emerges. Fixing the ends of this bevelled edge wall to the rear or lateral wall of the lid additionally strengthens the lid.

In advantageous versions, the bevelled edge wall is folded from a blank of the shell comprising a blank of the lid. The bevelled edge wall can have different kinds of cross-sectional shapes. A triangular shape is advantageous because it can be easily folded from a blank and it is stable. Other shapes, like quadrangular, polygonal in general or a shape including at least one curved face are conceivable as well.

In advantageous embodiments of the invention, the shell is designed as an outer shell, and the package further comprises an inner shell adapted to accommodate a plurality of tobacco-related articles. The inner shell is mounted in the outer shell, wherein the inner shell is moveable from a retracted position to an advanced position, which enables access to the smoking articles. Optionally, the inner shell, in its retracted position, is housed inside the outer shell. However, the outer shell can also be designed as a less comprehensive structure so that the outer shell and the lid, when closed, do not fully enclose the inner shell in its retracted position. In an example of the latter design, part of the inner shell protrudes at the bottom end of the outer shell when the lid is closed.

This design is particularly advantageous when the package further comprises a connector, preferably a hinged connector, between a portion of the inner shell and the lid, which engages the lid at a distance from the hinge line smaller than the dimension of the lid in a direction perpendicular to the hinge line and is adapted to push the lid into its opened state when the inner shell is moved into its advanced position and to pull the lid into its closed state when the inner shell is moved into its retracted position. Thus, the lid is automatically opened and closed, respectively, when the user moves the inner shell.

In this case, a cutout in the front wall and/or the lateral walls of the outer shell is adapted to expose part of the inner shell and to enable transmitting (optionally by means of an actuator, e.g., a knob or a pin) or exerting (e.g. by means of a thumb) a force onto the inner shell for moving the inner shell. The cutout can extend over more than one wall of the outer shell, e.g. in a corner area between the front wall and one of the lateral walls. Moreover, more than one cutout is conceivable as well. It is also possible that the bottom wall of the outer shell includes part of the cutout or an additional cutout.

Such package can be handled in a very convenient way. In contrast to a conventional package, which the user has to hold by one hand while opening the lid by the other hand, this package can be handled or operated just by means of one hand. The user can hold it in one hand, e.g. the rear wall of the outer shell facing his or her palm, and he or she can use his or her thumb in order to grasp through the cutout (or operate the actuator) and shift the inner shell by slightly pressing onto the inner shell and moving the thumb in a direction towards the lid or away from the lid, respectively. Because of the hinged connector, the lid opens and closes automatically. Again, this package permits an attractive design, and it can also be manufactured to a moderate price.

The one-hand use of the package is advantageous in many situations, for example while driving, when operating a computer, when talking on the phone, etc., or, generally, when the user has ready one hand only and wants to take a tobacco-related article. The package can rest well in the user's hand, and the one-hand use of the package is fast and convenient.

The inner shell can comprise a rear wall or a lateral wall having an upper edge, wherein the connector extends from this upper edge, having a first hinge line at or in the area of the upper edge, and wherein the connector has a second hinge line at the bottom side of the top wall. An advantageous geometrical condition for a reliable operation of the lid is that, in the closed state of the lid, the ratio of the distance between the first hinge line of the connector and the hinge line of the lid to the distance between the hinge line of the lid and the second hinge line of the connector is in the range from 0.5 to 1.0, preferably in the range from 0.70 to 0.85, e.g. about 0.78. Another useful geometrical condition for a space-saving, reliable and smooth coupling between the inner shell and the lid is that the distance between the first hinge line and the second hinge line of the connector is greater than the distance between the hinge line of the lid and the second hinge line of the connector, e.g. greater by an amount in the range of from 0.4 mm to 1.8 mm, or by an amount of about 0.7 mm.

The inner shell of the package can comprise a front wall providing a free access area, which facilitates the access to the contents of the inner shell when the inner shell is in its advanced position. This free access area can be designed, e.g., as a cutoff from the front wall or by means of a portion of the front wall having a lowered upper edge or by means of a front wall having generally a low upper edge. Preferably, when the inner shell is in its retracted position, the free access area of the inner shell does not overlap with the cutout of the outer shell, i.e. the free access area is not visible when the package is closed. This improves the appearance of the package.

Generally, the inner shell can comprise a front wall and a rear wall as well as two lateral walls opposite to each other and a bottom wall, which connect the front wall and the rear wall. It is also conceivable, however, that the inner shell has a lighter structure in which not all of the above-mentioned walls are designed as wall panels. In a lighter structure, an inner wrapper or a bundle wrapper can be applied for providing additional support to the contents of the package.

In advantageous embodiments including an inner shell, the front wall of the inner shell comprises a reinforced structure in order to improve its counteraction capabilities when the user touches this front wall, through the cutout, in order to move the inner shell. Such structure can be made from double-layer or triple-layer cardboard, e.g., using cardboard panels folded from a blank of the inner shell. It is also conceivable to apply a separate reinforcement panel which is attached to the rest of the inner shell.

Alternatively or additionally to this reinforcement structure, a reinforcement insert can be inserted into the inner shell. The reinforcement insert can be formed, e.g., as a plastic container, preferably made by injection-moulding. Such design still uses an inner shell, e.g. made from a cardboard blank, which can be coupled to the lid via a connector.

It is also possible to dispense with such cardboard inner shell and to design the inner shell as a plastic container which provides the desired rigidity. In this case, at least part of the connector can be formed as part of the plastic container, but it is also conceivable to attach a connector completely formed from a blank of the lid (e.g., as part of a blank of the outer shell) to the plastic container when assembling the package.

Preferably, the cutout of the outer shell is provided in the front wall of the outer shell. This is a location which allows for a convenient use of the package. However, it is possible as well to place the cutout at a different wall or in an area which extends over two walls or to provide more than one cutout.

The cutout of the outer shell can be located in a side area of the front wall of the outer shell, i.e. not in the centre area. This is particularly advantageous when the inner shell comprises a front wall providing a free access area (see above), because in this case the cutout of the outer shell can be placed at a location where it does not overlap with the free access area of the inner shell when the inner shell is in its retracted position. Moreover, in this design, the front wall of the outer shell exhibits a large continuous area which can be used for, e.g., warning hints.

The cutout of the outer shell can be formed from a blank of the outer shell in which at least part of the blank material of the cutout area is folded back to the inner face of the outer shell. In this way, the edges of the cutout are not sharp or somewhat irregular, but they are determined by the corresponding folding lines, which tend to be smooth and provide a greater thickness of the wall area surrounding the cutout. It can be advantageous when the blank material is not folded back at the top edge of the cutout, because that edge is not seen in detail when the user holds the package in a usual way, whereas a back-folded flap at the top edge of the cutout could interfere with an unimpeded assemblage of the package.

The inner shell can comprise, opposite to the cutout of the outer shell, a grip-enhancing surface. Such grip-enhancing surface can be presented, e.g., by means of a relief structure incorporated in the wall material of the inner shell or provided by a sticker glued to the inner shell in the area in question. Another option is a cutout structure, e.g. in a double-layer wall structure of the inner shell in which the outer layer comprises a series of cutouts whereas the inner layer folded to the outer layer is smooth. Other embodiments include a high-friction coating or rubber-like coating, either applied to a wall or wall area of the inner shell or to a sticker glued to the inner shell in the area in question. The grip-enhancing surface facilitates the operation of the package because it increases the frictional forces to, e.g., the user's thumb.

As already mentioned above, it is also conceivable that the cutout of the outer shell is designed as an aperture for an actuator for moving the inner shell and not as a relatively large access area for thumb operation of the inner shell movement.

There are many design options for the connector. For example, it can be folded by part of a blank of the outer shell and by part of a blank of the inner shell, wherein both parts are glued together upon assemblage of the package. Or it can be folded by part of a blank of the outer shell and glued directly to the inner shell. Or it can be folded by part of a blank of the inner shell and glued to the lid, which preferably is made from part of a blank of the outer shell. Regarding the shape of the connector, it can be relatively narrow measured in a direction along the hinge line of the lid. But it can also have the greatest or the almost greatest possible width measured in this direction. Generally, a larger width increases the rigidity of the structure. A trapezoidal shape of the connector, e.g., provides for a large extension where it is required for improving strength but also provides sloped edges which may facilitate the assemblage of the package.

In a different embodiment, the outer shell does not have a cutout in its front wall, rear wall or lateral walls. In this case, the outer shell rather comprises a cutout in its bottom wall (including a missing bottom). Otherwise, the embodiment can be constructed as outlined above. For advancing the inner shell, the user has to press upon its bottom (through the bottom aperture of the outer shell), while for retracting the inner shell, the user has to manually close the lid.

The embodiments of the package including an outer shell and an inner shell are not restricted to a design comprising one inner shell containing one charge or bundle of tobacco-related products only. It is also conceivable that the package includes one inner shell containing more than one bundle or that the package includes more than one inner shell. For example, the package can comprise at least two inner shells which are arranged side by side. In this case, preferably, the lid is swivelably connected to the rear wall of the outer shell. The lid can be formed from at least two separate parts, which are arranged side by side and are swivelably connected to the rear wall of the outer shell, wherein each of the separate parts of the lid is associated to one of the inner shells. The front wall of the outer shell can be provided with at least one cutout adapted to expose part of each of the inner shells and to enable exerting a force onto each of the inner shells for moving the respective inner shell and actuating the respective part of the lid via a hinged connector. This at least one cutout can be a single cutout in an area having access to all of the inner shells, or it can include at least two cutouts, one for each inner shell.

The description below turns now again to more general embodiments of the invention, which do not necessarily include a connector operating the lid.

The shell (or the outer shell) can be box-shaped. It can also comprise rounded edges, wherein preferably the longitudinal edges between the front wall and both lateral walls are rounded. Another option for the shape of the shell is a form with a hexagonal or octagonal cross-sectional shape, wherein the lateral walls or the front wall comprise side panels folded from the rest of the respective lateral wall or from the rest of the front wall (or rear wall) along fold lines running in parallel to a longitudinal axis of the package. Such shapes provide an attractive appearance of the package, whereas additional manufacturing expenses are moderate. If an inner shell is present, its shape can be adjusted accordingly.

In other embodiments of the invention, the shell (to which the lid is connected via the hinge line) is designed as an inner shell, which is at least partially surrounded by an outer shell. For example, the inner shell can accommodate and protect the smoking articles, and such outer shell may serve, e.g., as an operating means for opening and closing the lid, which will become more evident by a specific embodiment described further below.

The invention also covers packages in which the lid is formed from two separate parts, which are arranged opposite to each other, one part of the lid being swivelably connected to the rear wall or one of the lateral walls of the shell at the hinge line and the other part of the lid being swivelably connected to the front wall or the other one of the lateral walls of the shell at another hinge line. Each of both parts of the lid comprises a bevelled edge wall at least opposite to the respective hinge line. In this case, the lid when considered as a whole comprises two additional edges, i.e. the edge of the one part opposite to its hinge line and the edge of the other part opposite to the other hinge line, which edges face each other when the lid is closed. At least these edges comprise bevelled edge walls, which facilitate the closing process when the parts of the lid are swiveled into the closed state of the lid.

In advantageous embodiments of such packages, both parts of the lid are designed in general mirror symmetry with respect to each other, but non-symmetrical configurations are conceivable as well. In these embodiments, each part of the lid can be designed as described further above with a one-part lid in mind. For example, in a package comprising an inner shell, a connector for operating the one part of the lid can be connected to a rear wall of the inner shell, and a connector for operating the other part of the lid can be connected to a front wall of the inner shell.

Generally, the lid can comprise a gripping device, for example a tab, a nose, a gripping depression, or a gripping hole. When the lid is not opened automatically, such gripping device may be helpful in order to facilitate the opening process.

In advantageous embodiments of the invention, the shell (or the outer shell and/or the inner shell) of the package is folded from a blank made from cardboard (which term includes laminated cardboard) in the weight range from 180 $g/m^2$ to 290 $g/m^2$. This involves well-established techniques. Cardboard blanks can be designed in a large number of varieties. Other materials for the components of the package are conceivable as well, for example cardboard having a weight outside of the range indicated above or laminated materials or plastic materials or metal.

The package according to the invention can be filled with all kinds of tobacco-related articles, for example with cigarettes, cigarillos, cigars, tobacco-containing rods, smokeless tobacco, simulated smoking devices (e.g., electronic cigarettes), inhalors without combustion of tobacco, or aroma reservoirs.

When filled with tobacco-related articles, the package can be enclosed by, e.g., a cellophane or transparent plastic (e.g., polypropylene) wrapper, which is removed or partially removed by the user before opening the package for the first time. Such kinds of wrappers aid in maintaining the aroma and freshness of the tobacco-related articles and serve as a tamper-evident closure.

BRIEF DESCRIPTION OF THE DRAWING FIGURES

In the following, the invention is further explained by means of embodiments. The drawings show in FIG. 1 in parts (a) to (e) several views of a first embodiment of a package for tobacco-related articles according to the invention, i.e. in part (a) an isometric view of the package, the lid being partially opened, in part (b) an isometric view of the package, the lid being fully opened and an inner shell of the package having been moved to an advanced position, in part (c) a side view of the package, the lid being closed, in part (d) a side view of the package in the state according to part (b), and in part (e) a longitudinal section through the package in a plane containing the centre longitudinal axis, FIG. 2 in part (a) a plane view of a blank for the outer shell of the package according to FIG. 1 and in part (b) a plane view of a blank for the inner shell of the package according to FIG. 1, FIG. 3 in parts (a) to (d) several views of a second embodiment of a package for tobacco-related articles according to the invention, i.e. in part (a) an isometric view of the package, the lid being partially opened, in part (b) an isometric view of the package, the lid being fully opened and an inner shell of the package having been moved to an advanced position, in part (c) a bottom view of the package, and in part (d) a side view of the package in the state according to part (b), FIG. 4 in part (a) a plane view of a blank for the outer shell of the package according to FIG. 3 and in part (b) a plane view of a blank for the inner shell of the package according to FIG. 3, FIG. 5 in parts (a) and (b) isometric views of a third embodiment of a package according to the invention, which contains two bundles, i.e. in part (a) with the lid partially opened and in part (b) with an inner shell of the package in an advanced position and the lid being fully opened, FIG. 6 in parts (a) and (b) isometric views of a fourth embodiment of a package according to the invention, i.e. in part (a) with a two-part lid partially opened and in part (b) with two inner shells of the package in an advanced position, the two-part lid being fully opened, FIG. 7 an isometric view of a fifth embodiment of a package according to the invention, the lid being partially opened, FIG. 8 in parts (a) and (b) schematic longitudinal sections of a sixth embodiment of a package according to the invention, the lid being closed, i.e. in part (a) in a plane in parallel to the lateral walls of a shell of the package and in part (b) in a plane in parallel to the front wall of the shell, FIG. 9 a schematic longitudinal section of a seventh embodiment of a package according to the invention in a plane in parallel to the lateral walls of a shell of the package, the lid comprising two parts and being closed, and FIG. 10 a schematic longitudinal section of an eighth embodiment of a package according to the invention in a plane in parallel to the lateral walls of a shell of the package, the lid being hinged to an inner shell and being closed.

DETAILED DESCRIPTION OF THE PREFERRED EMBODIMENTS

FIG. 1 illustrates a first embodiment of a package 1 for tobacco-related articles.

The package 1 comprises an outer shell 2, a lid 4 adapted to close the outer shell 2, and an inner shell 6, which is movable within the outer shell 2 from a retracted position, see FIG. 1(*a*), to an advanced position, see FIG. 1(*b*).

The inner shell 6 accommodates a bundle 8 of tobacco-related articles, e.g. a bundle of cigarettes. The bundle 8 is provided in a conventional manner, e.g. by wrapping a plurality of cigarettes with, e.g., an aluminium foil or aluminium-laminated paper. In the state of the package 1 shown in FIG. 1(*b*), the bundle 8 can be easily opened in order to take out a cigarette.

The outer shell 2 comprises front wall 10, a rear wall 12, two lateral walls 14 and a bottom wall 16. In the embodiment, the top side 18 provides a free cross-sectional area.

The front wall 10 includes a cutout 20, i.e. an aperture fully penetrating the front wall 10. In the embodiment, the cutout 20 is located approximately in the centre area of the front wall 10.

The lid 4 is connected to the upper edge of the rear wall 12 via a hinge line 22 so that it can be swiveled from a closed state, see FIG. 1(*c*), to a fully opened state, see FIG. 1(*b*), FIG. 1(*d*), and FIG. 1(*e*). In the embodiment, the lid 4 comprises a top wall 24 having a front edge 26 and a rear edge 28, see FIG. 1(*d*), as well as two lateral edges 30, see FIG. 1(*a*). Its bottom side is designated by reference numeral 32, see FIG. 1(*e*). The hinge line 22 runs along the rear edge 28 of lid 4 and is designed from a fold line of the blank the outer shell is formed from.

Moreover, the lid 4 comprises a front edge wall 34 extending from front edge 26 and two lateral edge walls 36 extending from the two lateral edges 30 of the top wall 24 of lid 4. As can be seen in FIGS. 1(*a*), (*b*), (*d*) and (*e*), the edge walls and 36 have a "bevelled" shape. That means, they extend from the front edge 26 and the lateral edges 30, respectively, in a somewhat inwardly inclined manner such that the edge walls 34 and 36 can enter the interior space of the outer shell 2 when the lid 4 is closed. Consequently, the edge walls 34 and 36 are not visible when the lid 4 is closed, see FIG. 1(*c*). In other words, when the lid 4 is closed, only its top wall 24 can be seen, which imparts to the package 1 a striking design.

When the lid 4 is closed, the edge walls 34 and 36 are located inside the outer shell 2 and stabilise the package 1. In the embodiment, the edge walls 34 and 36 have a triangular cross-sectional shape, see FIG. 1(*e*), which provides for a generally large strength of the edge walls 34 and 36. Moreover, the bevelled or inclined shape of the edge walls 34, 36 facilitates the closing process of the lid 4. In variants of the embodiment according to FIG. 1, the cross-sectional shape of the edge walls is not triangular, but different, e.g. more or less rounded.

The inner shell 6 comprises a front wall 40 and a rear wall 42, see FIG. 1(*e*), two lateral walls 44, see FIG. 1(*d*), as well as a bottom wall 46, see FIG. 1(*e*). The upper edge of the front wall 40 and part of the upper edges of the lateral walls 44 are arranged below the upper edge of the rear wall 42, see FIG. 1(*b*) and FIG. 1(*d*), which provides a free access area 48 for facilitating the removal of the tobacco-related articles of bundle 8.

In the area of the cutout 20 of the outer shell 2, the front wall 40 of the inner shell 6 is coated with a grip-enhancing, high-frictional material, e.g. a rubber-like material.

The inner shell 6 is coupled to the lid 4 by means of a hinged connector 50. As shown in FIG. 1(*b*), the connector 50 extends over most of the width of package 1. FIG. 1(*e*) illustrates the details of the connector 50 and explains how it works.

In the embodiment, the connector 50 extends from the upper edge of the rear wall 42 of the inner shell 6 at a first hinge line 52. The connector 50 is attached to the bottom side 32 of the top wall 24 of lid 4 at a second hinge line 54. The connector 50 can swivel about the hinge lines 52 and 54.

Moreover, in the embodiment, the distance between the first hinge line 52 and the second hinge line 54 is greater than the distance between the second hinge line 54 and the hinge line 22 of lid 4, e.g. by an amount of about 0.7 mm.

When the lid 4 is in its closed state, see FIG. 1(*c*), a user can place the package 1 in the palm of one of his or her hands, touch the front wall 40 of the inner shell 6 through the cutout 20 in the outer shell 2 with his or her thumb and move the thumb upwards. In this way, the user shifts the inner shell 6 from its retracted position upwards until it achieves its fully advanced position. During the movement of the inner shell 6, the connector 50 opens the lid 4 by swiveling it about the hinge line 22. Since during all times of this movement, the hinge lines 22, 52 and 54 form a triangle in the plane of FIG. 1(*e*), the swivel movement of the lid 4 is well-defined.

Initially, when lid 4 is closed, the ratio of the distance between the first hinge line 52 of the connector 50 and the hinge line 22 of the lid 4 to the distance between the hinge line 22 of the lid 4 and the second hinge line 54 of the connector 50 is about 0.78, in the embodiment. This implies that, on the one hand, the lid 4 experiences a sufficient torque during the initial moments of the opening movement, whereas, on the other hand, the upper edge of the inner shell 6, i.e. the first hinge line 52, is not located too much below the hinge line 22, i.e. the connector mechanism does not waste much space in top of the inner shell 6 when the inner shell 6 assumes its retracted position.

When the user moves his or her thumb downwards, the inner shell 6 is shifted back to its retracted position, and the connector 50 pulls the lid 4 down to its closed state.

Other numerical values of the numbers presented above can be chosen as well. A person skilled in the art can optimise the geometry of the connector 50 depending on the actual dimensions of the outer shell 2 and the inner shell 6.

Figure 2:
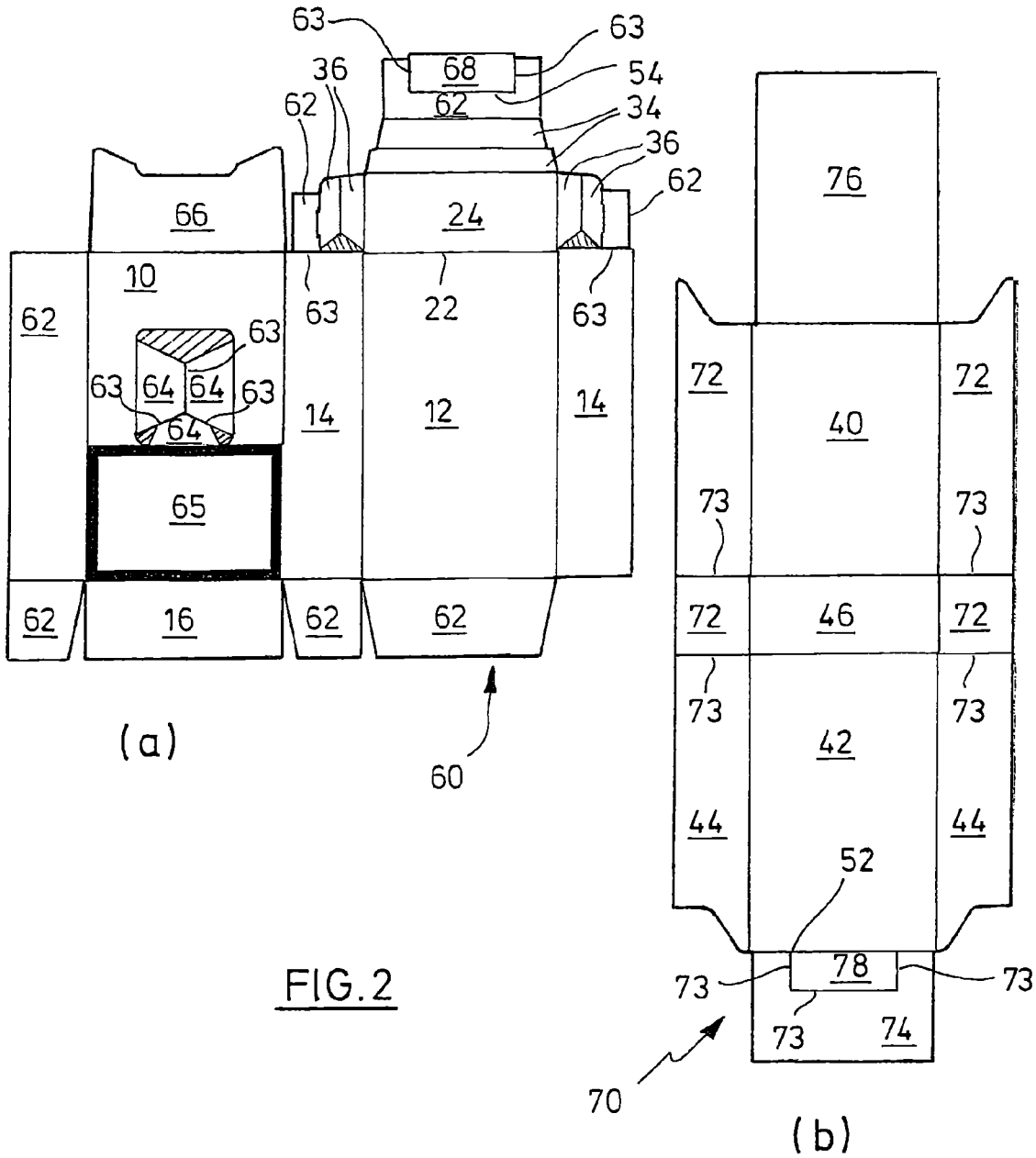

FIG. 2 illustrates a blank 60 of the outer shell 2, see FIG. 2(*a*), as well as a blank 70 of the inner shell 6, see FIG. 2(*b*). In the embodiment, both blanks are made from cardboard of a usual thickness, e.g. in the weight range from 180 g/m$^2$ to 290 g/m$^2$. Other blank materials are conceivable as well, e.g. laminated cardboard or plastic materials.

In FIG. 2(*a*), the front wall 10, the rear wall 12, the lateral walls 14, and the bottom wall 16 of the outer shell 2 are indicated by their reference numerals. Moreover, any gluing tabs are designated by reference numeral 62 and any cut-through lines by reference numeral 63. The lines not indicated by reference numerals are usual fold lines. The hatched areas are completely cut away.

The area of the cutout 20, three tabs 64 are provided which are folded back during the assemblage of the package and are glued to the inner side of the front wall 10 in order to form smooth and well-appearing edges of the cutout 20.

Reference numeral 65 indicates an area for a warning hint. The size of this area is prescribed by national regulations. In blank 60, the area 65 is located below the cutout 20.

Similar to the tabs 64, a reinforcement panel 66 is folded back during assemblage of the outer shell 2 in order to strengthen the outer shell 2 and form a well-appearing upper edge of the front wall 10.

FIG. 2(*a*) also illustrates how the lid 4 including its top wall 24 and the edge walls 34 and 36 is formed from the blank 60. The edge walls 34 and 36 are folded about their respective fold lines and are fixed to the lower side of top wall 24 by means of respective gluing tabs 62. A first part 68 of the hinged connector 50 is incorporated in the gluing tab 62 of the front edge wall 34.

The individual steps for assembling the outer shell 2 from blank 60 are evident to a person skilled in the art.

In a similar way, the blank 70 of the inner shell 6 shown in FIG. 2(*b*) comprises the front wall 40, the rear wall 42, both lateral walls 44 and the bottom wall 46 of the inner shell 6 and additionally some gluing tabs 72. Cut-through lines are indicated by reference numeral 73. Part 74 is a reinforcement part which, after having been folded and glued to the rear wall 42, stabilises the rear wall 42 and provides for a well-appearing upper edge of the rear wall 42.

A reinforcement panel 76 is folded back (and preferably glued) to the inner side of the front wall 40 in order to stabilise the front wall 40 of the inner shell 6. When the user puts his or her thumb through the cutout 20, he or she exerts some force onto the front wall 40 of the inner shell 6. As long as the bundle 8 in the inner shell 6 is still complete or almost complete, the front wall 40 of the inner shell 6 does not much yield under this pressure. During use of the package 1, however, the residual bundle 8 gets smaller and does not stabilise the inner shell 6 anymore. For this reason, the rigid front wall 40 is advantageous. In addition to reinforcement panel 76, another reinforcement panel can be used. This additional reinforcement panel can be part of the blank of the inner shell 6. A separate reinforcement panel, e.g. made from a stronger material, which is attached during the assembly process of the inner shell 6, is conceivable as well. As an alternative, the inner shell could be made completely from a sufficiently strong plastic material, e.g. as an injection-moulded part.

FIG. 2(*b*) also shows a second part 78 of the connector 50 which is cut out from the reinforcement part 74 along three cut-through lines 73.

Again, it is evident to a person skilled in the art how the inner shell 6 is assembled from blank 70.

After assemblage of the outer shell 2 and the inner shell 6 from the blanks 60 and 70, respectively, is complete, the inner shell 6 is inserted in the outer shell 2 via top side 18, and the first part 68 and the second part 78 of the connector 50 are glued together, e.g. in a position of the lid 4 as in FIG. 1(*a*).

Different designs of the connector are conceivable as well, e.g. a connector fully integrated in the blank of the outer shell or a connector fully integrated in the blank of the inner shell. Moreover, the shape of the connector can be different from that shown in FIG. 2, e.g. an even wider connector which would stabilise the package even more than the connector 50 of package 1.

Figure 3:
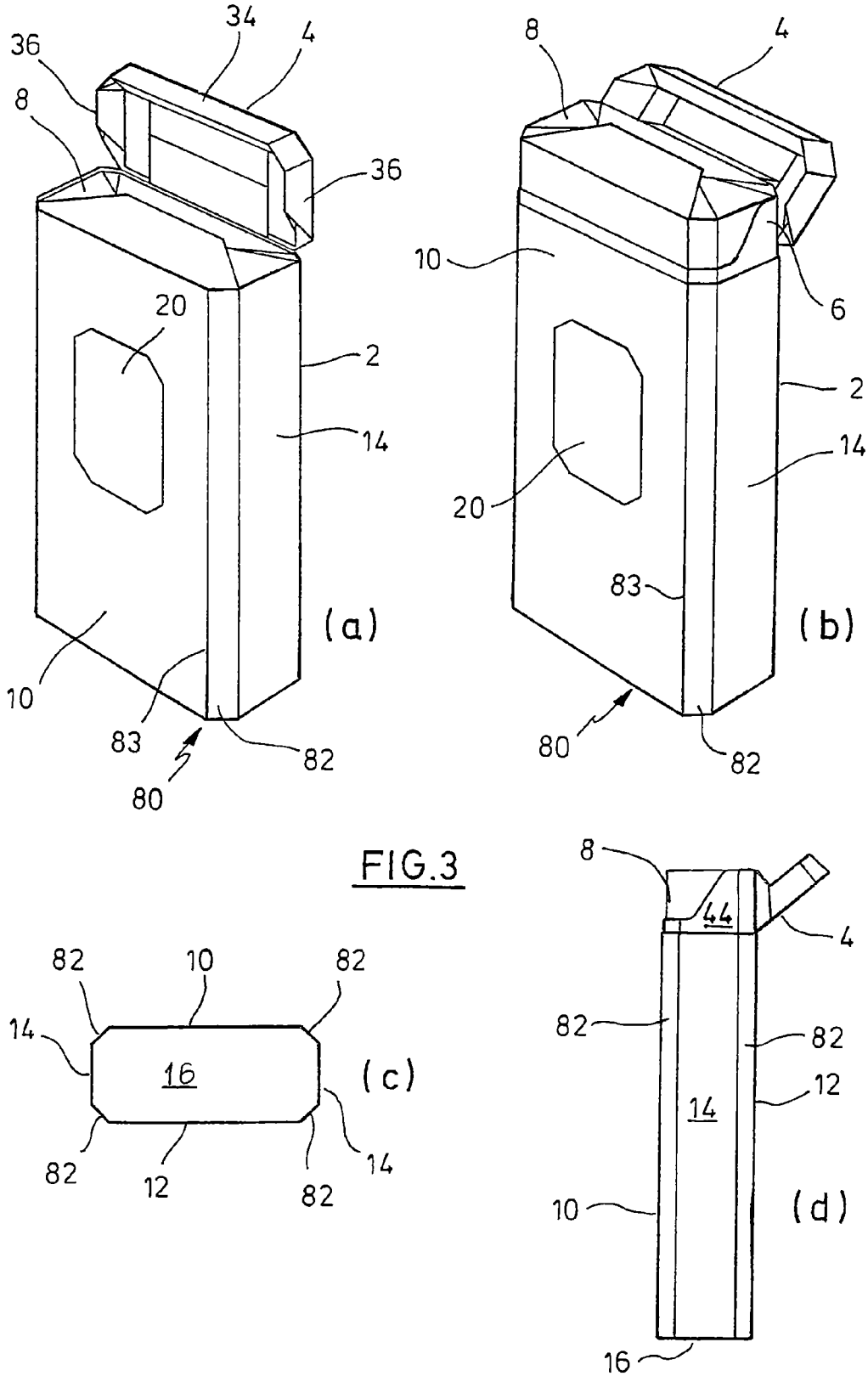

FIG. 3 illustrates another embodiment of a package for tobacco-related articles, which is designated by reference numeral 80.

The package 80 is similar to the package 1 described so far. For this reason, for most parts of package 80, the same reference numerals are used as for package 1. These parts, which include the opening mechanism of the lid 4, are not explained again.

The main difference between the packages 80 and 1 is the outer shape. In package 80, the outer shell 2 has an octagonal cross-sectional shape, see in particular the bottom view according to FIG. 3(*c*). This octagonal shape is achieved by means of side panels 82 which are folded by fold lines 83 from the front wall 10 and the rear wall 12, respectively. By definition, the side panels 82 are considered as parts of the front wall 10 and the rear wall 12, respectively, but they could be considered as parts of the lateral walls 14 as well.

Figure 4:
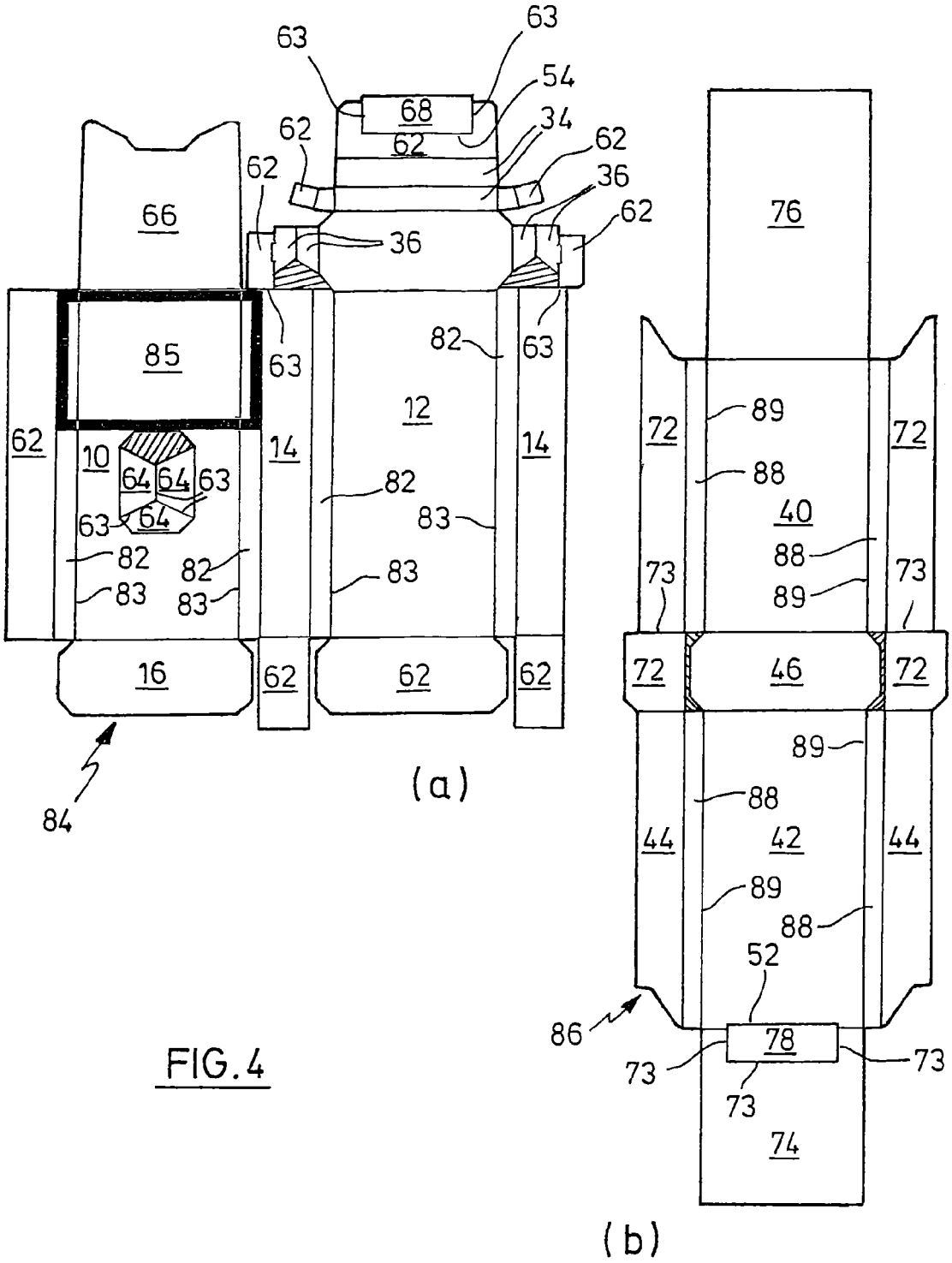

FIG. 4(*a*) shows a blank 84 for the outer shell of package 80. In this case, a warning-hint area 85 is located above the cutout of the front wall. Generally, the cutout in the front wall of the outer shell should not overlap with the free access area of the inner shell when the inner shell is in its retracted position.

A blank 86 of the inner shell of package 80 is shown in FIG. 4(*b*). The shape of the inner shell is adapted to that of the outer shell, i.e. the inner shell has an octagonal cross-sectional shape as well. In FIG. 4(*b*), the corresponding side panels and fold lines are indicated by reference numerals 88 and 89, respectively.

Otherwise, the explanation given for the assemblage of package 1 by means of the blanks 60 and 70 holds for the assemblage of the package 80 by means of the blanks 84 and 86 in an analogous manner.

Figure 5:
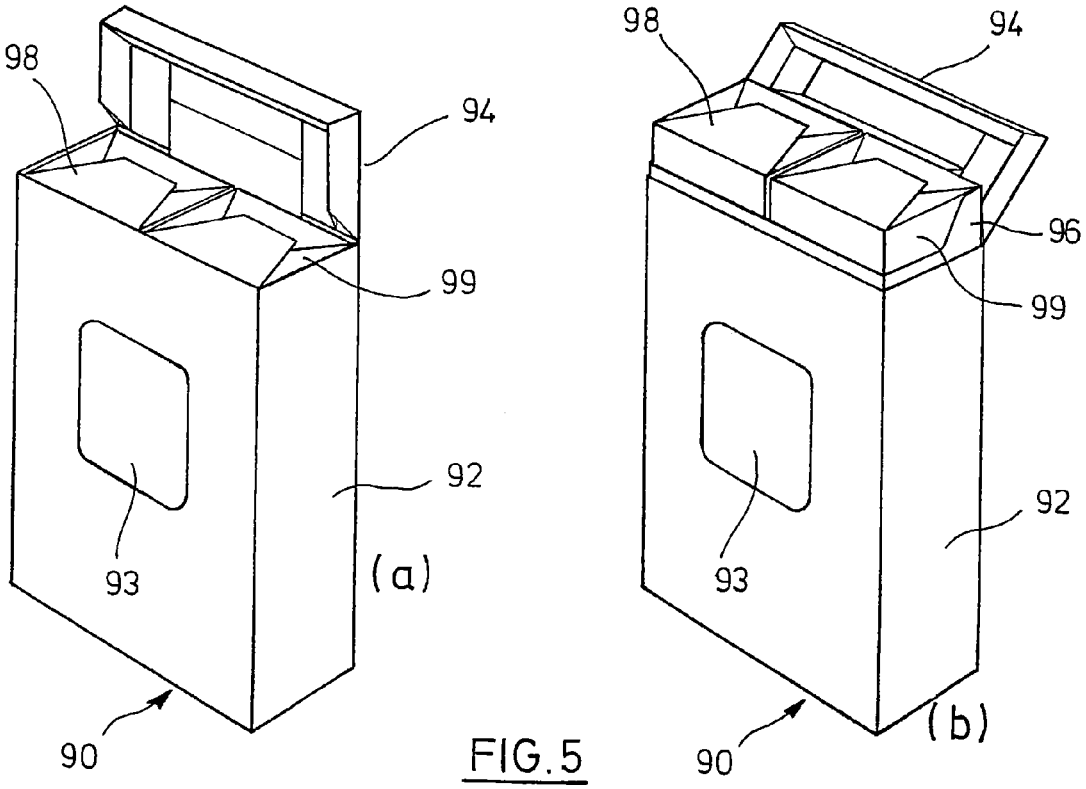

FIG. 5 illustrates a third embodiment of the package for tobacco-related articles, which is designated by reference numeral 90. In this embodiment, an outer shell 92 with a cutout 93 at its front wall can be closed at its top side by means of a swivelable lid 94. An inner shell 96 is shiftably mounted in the outer shell 92 and can be moved from a retracted position to an advanced position. The lid 94 is coupled to the inner shell 96 by means of a connector.

As before, a user can move the inner shell 96 and automatically open the lid 94 by gripping with, e.g., the thumb through the cutout 93 and sliding the inner shell 96 upwards. So far, the package 1 and the package 90 are very similar.

In contrast to package 1, however, package 90 is wider such that its inner shell 96 can accommodate two bundles 98 and 99 of tobacco-related articles, e.g. cigarettes. In practice, one bundle is consumed first, while the other one stays closed at the beginning to keep its freshness. Afterwards, the other bundle is consumed.

Figure 6:
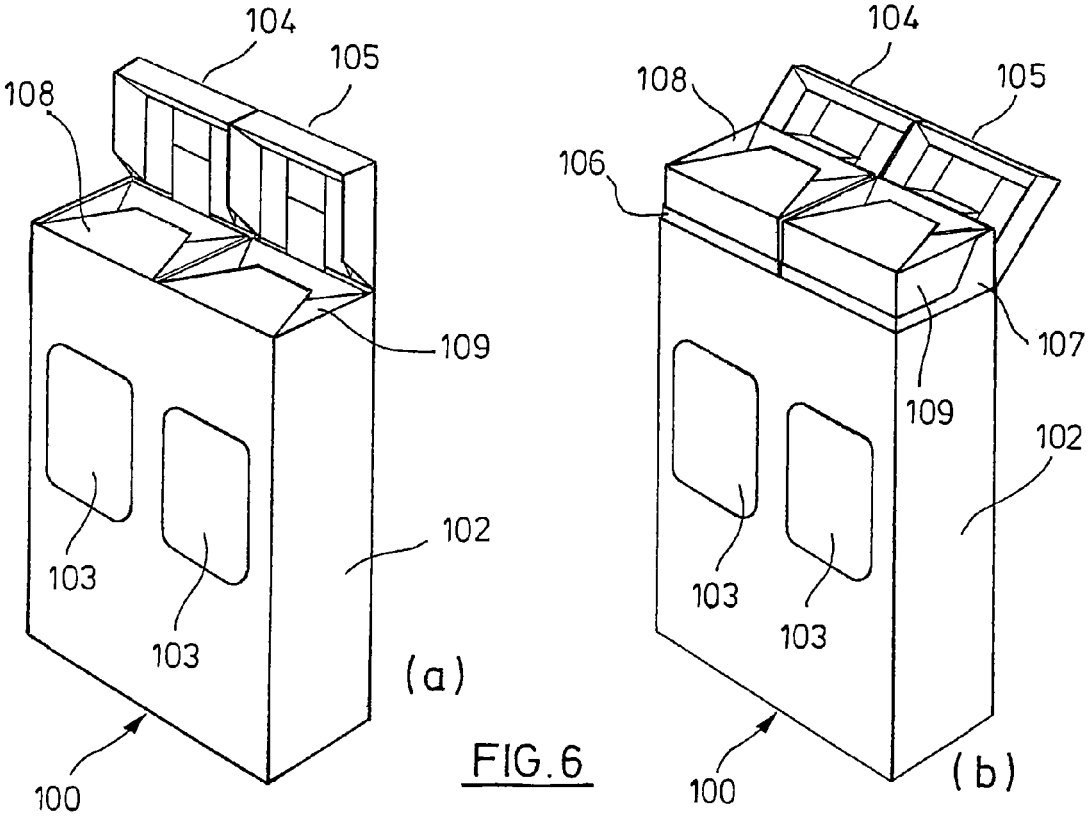

A fourth embodiment of the package for tobacco-related articles is shown in FIG. 6. This package is designated by reference numeral 100.

The package 100 comprises an outer shell 102 with two cutouts 103 in its front wall. The lid, which is swivelably connected to the upper edge of the rear wall of the outer shell 102, consists of two parts, a first part 104 and a second part 105. Both parts 104 and 105 of the lid are independent from each other.

The outer shell 102 houses two inner shells, a first inner shell 106 and a second inner shell 107. The first inner shell 106 accommodates one bundle 108 of tobacco-related articles, the second inner shell 107 one bundle 109.

The first part 104 of the lid is coupled to the first inner shell 106 by means of a connector designed as connector 50 of the embodiment according to FIG. 1. Similarly, the second part 105 of the lid is coupled to the second inner shell 107 by means of a corresponding connector. Consequently, both inner shells 106 and 107 including the parts of the lid coupled thereto, i.e. the first part 104 and the second part 105, respectively, can be moved independently from each other. In other words, the package 100 can be considered as two packages 1 arranged side by side with a common outer shell 102.

Figure 7:
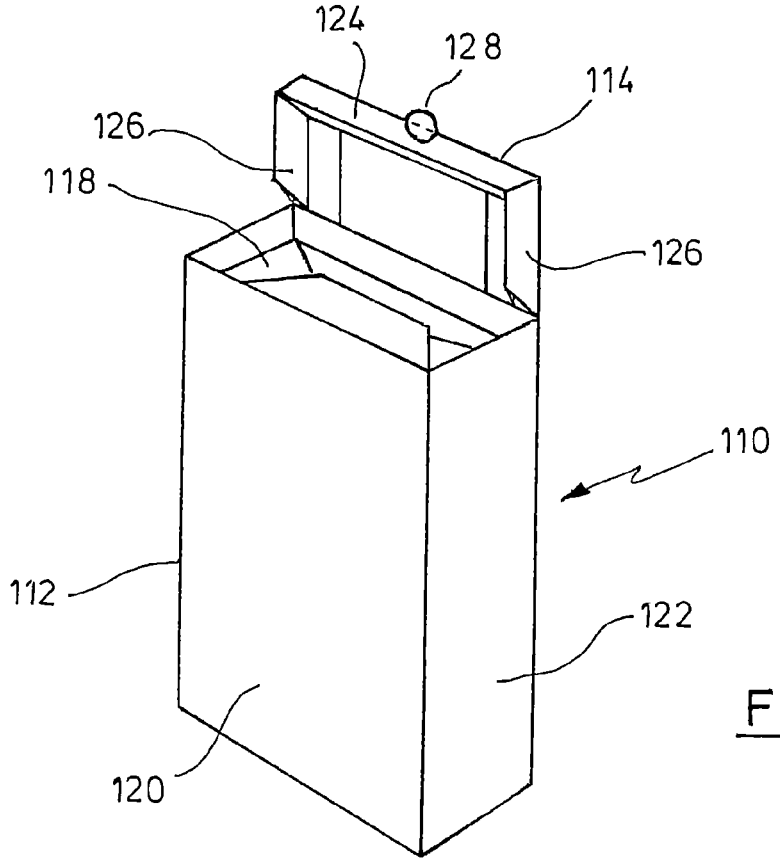

FIG. 7 shows a fifth embodiment of a package for tobacco-related articles. This package, designated by reference numeral 110, in its outer appearance is similar to package 1 of the first embodiment, but it does not comprise an outer shell plus an inner shell, but just a shell 112.

A lid 114 is hingedly connected to the rear wall of the shell 112. In the view of FIG. 7, the lid 114 has been partially opened. A bundle 118 of cigarettes is still closed.

The shell 112 comprises a front wall 120, two lateral walls 122, the rear wall already mentioned and a bottom wall. In contrast to the first embodiment, the package 110 does not have a cutout comparable to the cutout 20 because there is no inner shell to be moved via the cutout. Moreover, the package 110 does not include a connector for automatically opening the lid 114.

Otherwise, the lid 114 is designed similar to lid 4. It comprises a bevelled edge wall 124 at the front edge of its top wall and two bevelled edge walls 126 at the lateral sides. In order to open the lid 114, a user can grasp a tab 128 protruding from the top wall of the lid 114 and cut out from the part of the blank used for forming the bevelled edge wall 124.

Thus, the package 110 is simple from a technical point of view, but nevertheless it has an appealing design because of the structure of its lid 114.

Figure 8:
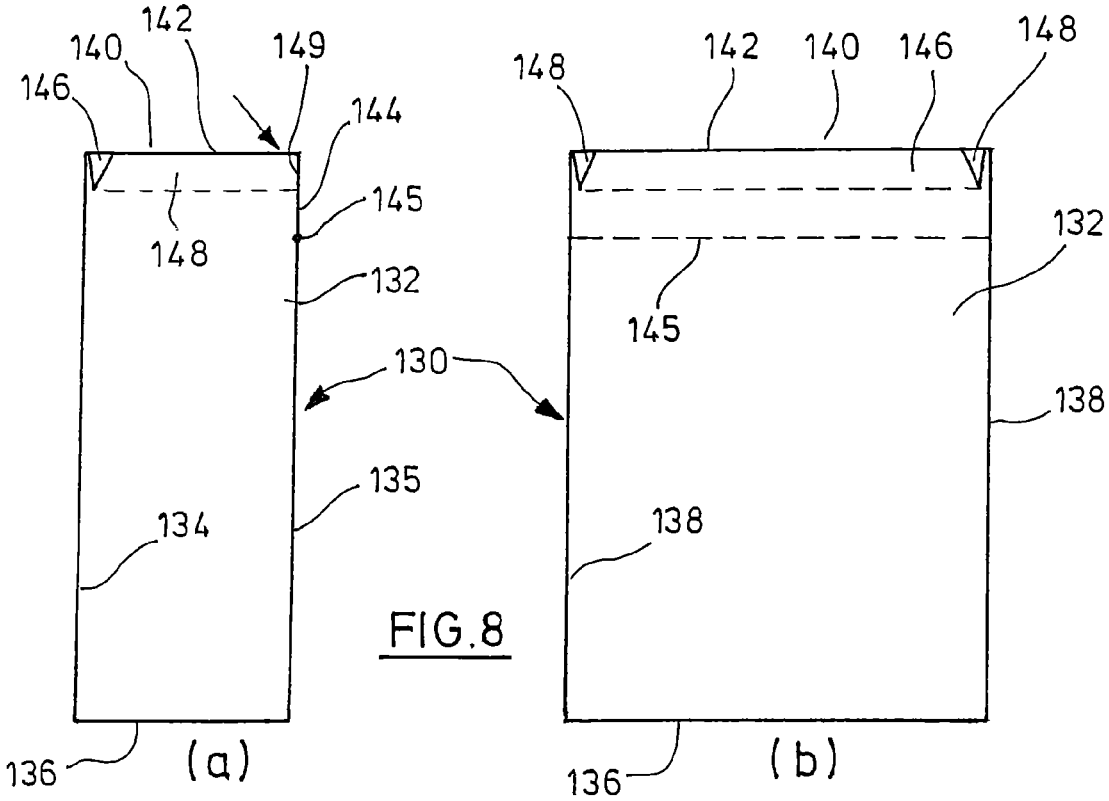

FIG. 8 illustrates a sixth embodiment of a package for tobacco-related articles, which is designated by reference numeral 130. Again, this embodiment just comprises a shell 132 but no additional inner shell.

It can be seen from the longitudinal section in FIG. 8(*a*), i.e. a section in a plane in parallel to the lateral walls of shell 132, that the package 130 includes a front wall 134, a rear wall 135 and a bottom wall 136. The longitudinal section in a plane in parallel to the front wall 134 shows the lateral walls 138 of shell 132, see FIG. 8(*b*). In the embodiment, the lateral walls 138 of the shell 132 are rectangular and extend over the full height of package 130. The top side of the shell 132 can be closed by a lid 140. The lid 140 comprises a top wall 142 and a rear wall 144. At the free end of its rear wall 144, the lid 140 is connected to the rear wall 135 of the shell 132 along a hinge line 145, see FIG. 8(*a*).

A bevelled edge wall 146 having a triangular cross-sectional shape extends from the edge of the top wall 142 opposite to the hinge line 145, see FIG. 8(*a*). In FIG. 8(*b*) the bevelled edge wall 146 is schematically indicated in dashed lines. At the lateral sides of the top wall 142, there are provided bevelled edge walls 148, see FIG. 8(*b*) and the indication in dashed lines in FIG. 8(*a*). In order to stabilise the lid 140, the ends 149 of the bevelled edge walls 148 are glued to the rear wall 144 of lid 140.

To open the lid 140, the user can press the top wall 142 of the lid 140 at a location and in a direction as indicated by the arrow in FIG. 8(*a*). Under the action of such force, the lid 140 will swivel into its opened state. To close the lid 140, it is sufficient to press its top wall 142 in a downward direction. Because of their shape, the bevelled edge walls 146 and 148 will easily enter into the shell 132.

Figure 9:
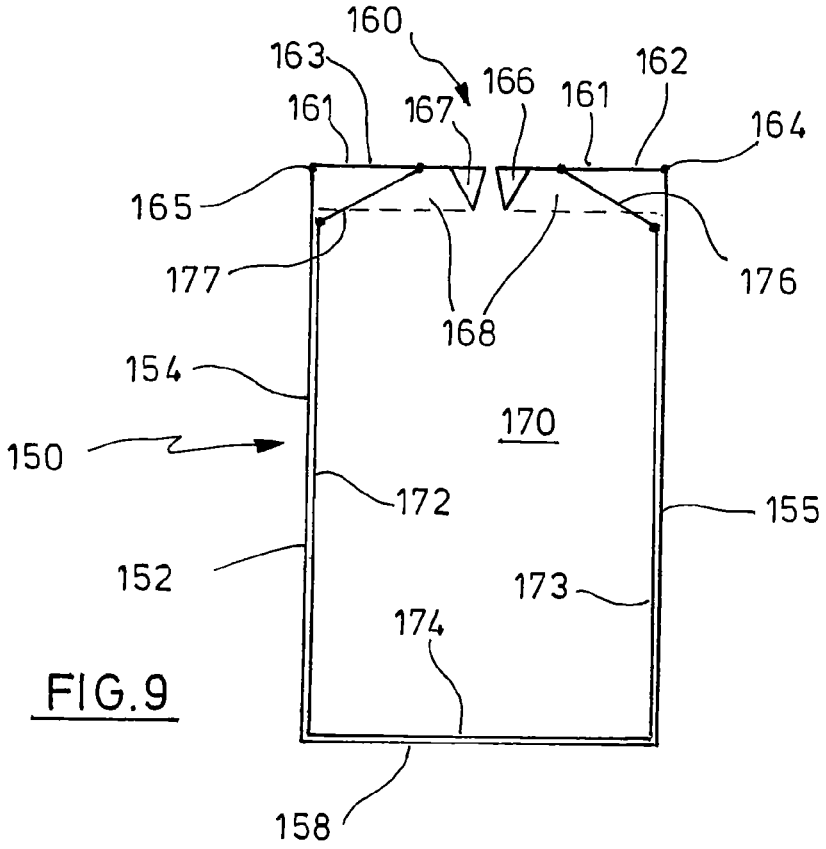

As a seventh embodiment of a package for tobacco-related articles, FIG. 9 illustrates a package 150, in which the lid is formed from two separate parts. Moreover, the package 150 includes an inner shell which can be moved to an advanced position in order to automatically open both parts of the lid.

The package 150 comprises an outer shell 152 having a front wall 154, a rear wall 155, and a bottom wall 158.

The lid, designated by reference numeral 160 and having a general top wall 161, is composed of a first part 162 and a second part 163. The first part 162 is connected to the rear wall 155 of the outer shell 152 along a hinge line 164. Similarly, the second part 163 is connected to the front wall 154 via a hinge line 165. At its edge opposite to the hinge line 164, the first part 162 comprises a bevelled edge wall 166. Similarly, the second part 163 comprises a bevelled edge wall 167. Moreover, bevelled edge walls 168 indicated in FIG. 9 in dashed lines are provided at the lateral edges of the first part 162 and the second part 163 of the lid 160.

The inner shell, designated by reference numeral 170, has a front wall 172, a rear wall 173, a bottom wall 174 and two lateral walls. A connector 176 is hingedly connected to the upper end of the rear wall 173 of the inner shell 170 and to an area on the bottom side of the first part 162 of lid 160 in between the hinge line 164 and the bevelled edge wall 166. Similarly, a hinged connector 177 is arranged in the area of the second part 163 of the lid 160.

To open the package 180, a user grasps through a cutout provided, in the embodiment, in one of the lateral walls of the outer shell 152 and moves the inner shell 170 in the upward direction, which causes the connectors 176 and 177 to swivel the parts 162 and 163 of the lid 160 into the open state. When the inner shell 170 is shifted in the downward direction, the connectors 176 and 177 pull the lid 160 into the closed state. Because of the triangular cross-sectional shape of the bevelled edge walls 166 and 167, there are no geometrical problems during the closing procedure.

Figure 10:
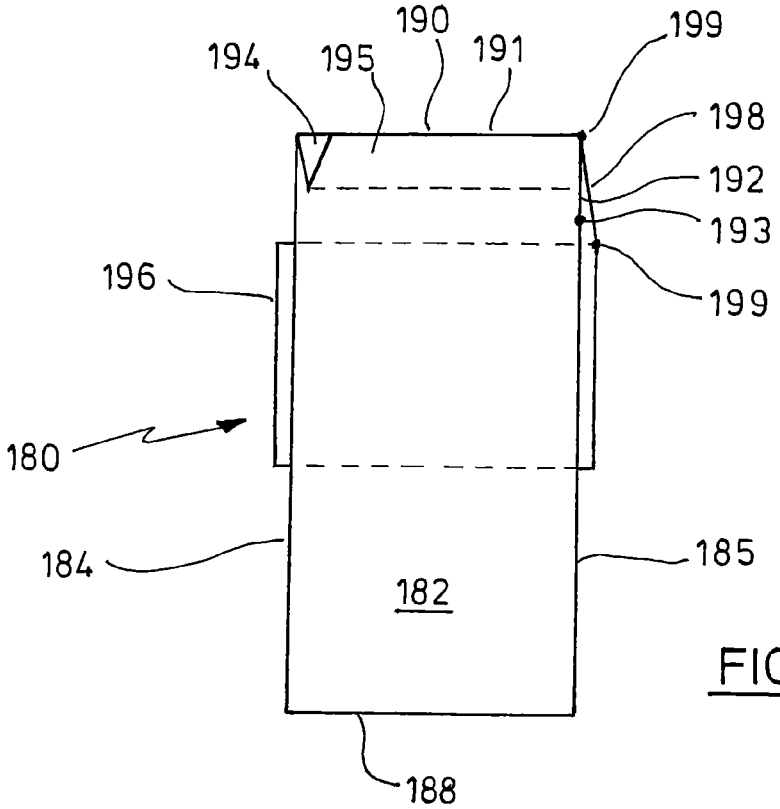

FIG. 10 shows, as an eighth embodiment, a package 180 in which the lid is wingedly connected to an inner shell 182.

The inner shell 182 comprises a front wall 184, a rear wall 185, a bottom wall 188 as well as two lateral walls not visible in the longitudinal section according to FIG. 10.

The lid, designated by 190, includes a top wall 191 and a rear wall 192, which is connected to the upper end of the rear wall 185 of the inner shell 182 via a hinge line 193. The lid 190 is stabilized by a bevelled edge wall 194 at the front edge of the top wall 191 and by bevelled edge walls 195 at the lateral sides, as indicated in FIG. 10 by a dashed line.

Moreover, the package 180 comprises an outer shell 196. The outer shell 196 surrounds the inner shell 182 and is shaped like a short sleeve. A connector 198 is hingedly connected to the outer shell 196 and the rear edge of top wall 191 of the lid 190 along two hinge lines 199, as indicated in FIG. 10.

Upon shifting the outer shell 196 in the downward direction, the connector 198 pulls the lid 190 into an opened state. When the outer shell 196 is moved upwardly, the lid 190 closes, wherein the bevelled edge walls 194 and 195 easily fit into the inner shell 182.

The invention claimed is:

1. A package for tobacco-related articles, said package comprising:

a shell including a front wall, a rear wall, and two lateral walls opposite to each other and connecting the front wall and the rear wall, said shell having a top side; and a lid adapted to close the top side of the shell when in a closed state, said lid being swivelably connected to the rear wall or one of the lateral walls of the shell at a lid hinge line and being swivelable about the lid hinge line for transfer between the closed state and an opened state, wherein the lid comprises a top wall including a front edge, a rear edge, two lateral edges, and a bottom side and is adapted to close the top side of the shell when the lid is in the closed state, wherein a beveled edge wall extends from at least a first edge of the top wall, said first edge being located opposite to the lid hinge line, wherein the beveled edge wall fits into the shell when the lid is in the closed state so that the beveled edge wall is accommodated in the shell and generally not visible, wherein the beveled edge wall includes a first wall portion fixed in an inwardly inclined manner and a second wall portion at least in part spaced from the first wall portion such that the beveled edge wall presents a cross-sectional shape.

2. Package according to claim 1, wherein the lid hinge line is located at the rear edge or at one of the lateral edges of the top wall.

3. Package according to claim 2, wherein the beveled edge wall extends from a plurality of edges of the top wall except the edge at which the lid hinge line is located.

4. Package according to claim 1, wherein the lid includes a rear wall extending from the rear edge and having a free end or a lateral wall extending from one of the lateral edges and having a free end, wherein the lid hinge line is located at the free end.

5. Package according to claim 1, wherein the beveled edge wall is folded from a blank of the shell that includes a blank of the lid.

6. Package according to claim 1, wherein the shell comprises a bottom wall, wherein the two lateral walls and the bottom wall connect the front wall and the rear wall.

7. Package according to claim 1, wherein the shell is an outer shell, said package further comprising an inner shell adapted to accommodate a plurality of tobacco-related articles and shiftably mounted in the outer shell, wherein the inner shell is moveable from a retracted position to an advanced position that enables access to the tobacco-related articles.

8. Package according to claim 7, wherein the package further comprises:

a cutout in at least one wall of the outer shell, selected from the group consisting of the front wall, the rear wall, and the two lateral walls, wherein the cutout is adapted to expose a part of the inner shell and to enable transmission of a force onto the inner shell for moving the inner shell; and a connector extending between a portion of the inner shell and the lid, wherein the connector engages the lid at a distance from the lid hinge line smaller than a dimension of the lid in a direction perpendicular to the lid hinge line, said connector being adapted to shift the lid into the opened state when the inner shell is moved into the advanced position and to shift the lid into the closed state when the inner shell is moved into the retracted position.

9. Package according to claim 8, wherein the cutout is adapted to enable exertion of a force onto the inner shell for moving the inner shell.

10. Package according to claim 8, wherein the inner shell comprises an inner rear wall having an upper edge or an inner lateral wall having an upper edge, wherein the connector extends from said upper edge such that a first connector hinge line is defined at or adjacent said upper edge, wherein a second connector hinge line is defined at the bottom side of the top wall.

11. Package according to claim 10, wherein, in the closed state of the lid, a ratio of a distance between the first connector hinge line and the lid hinge line to a distance between the lid hinge line and the second connector hinge line is in the range from 0.5 to 1.0.

12. Package according to claim 7, wherein the package comprises at least two inner shells which are arranged side by side.

13. Package according to claim 1, wherein the shell is an inner shell, which is at least partially surrounded by an outer shell.

14. Package according to claim 1, wherein the lid is formed from separate first and second parts, which are arranged opposite to each other, the first part of the lid being swivelably connected to the rear wall or a first one of the lateral walls of the shell at the lid hinge line and the second part of the lid being swivelably connected to the front wall or a second one of the lateral walls of the shell at a second lid hinge line, wherein each of the first and second parts of the lid comprises a beveled edge wall at least opposite to the lid hinge line and the second lid hinge line, respectively.

15. Package according to claim 14, wherein the first and second parts of the lid are designed in a general mirror symmetry with respect to each other.

16. Package according to claim 1, wherein the lid comprises a gripping device.

17. Package according to claim 1, wherein the package contains tobacco-related articles, wherein the tobacco-related articles are selected from the group consisting of cigarettes, cigarillos, cigars, tobacco-containing rods, smokeless tobacco, simulated smoking devices, inhalors without combustion of tobacco, and aroma reservoirs.

18. Package according to claim 4, wherein the lid includes a plurality of edge walls.

19. Package according to claim 7, wherein the inner shell, in the retracted position, is housed inside the outer shell.

20. Package according to claim 8, wherein the connector is a hinged connector.

21. Package according to claim 11, wherein the ratio of the distance between the first connector hinge line and the lid hinge line to the distance between the lid hinge line and the second connector hinge line is in the range from 0.70 to 0.85.

22. Package according to claim 21, wherein the ratio of the distance between the first connector hinge line and the lid hinge line to the distance between the lid hinge line and the second connector hinge line is about 0.78.

23. Package according to claim 12, wherein the lid is formed from at least two separate parts, which are arranged side by side and are swivelably connected to the rear wall of the outer shell, wherein each of the separate parts of the lid is associated with a corresponding one of the inner shells.

24. Package according to claim 16, wherein the gripping device is selected from a group consisting of a tab, a nose, a gripping depression, and a gripping hole.

25. Package according to claim 1, said first wall portion and said second wall portion being connected along a fold line.

26. Package according to claim 1, said beveled edge wall being fixed to the top wall using glue.

27. Package according to claim 1, said cross-sectional shape being selected from the group consisting of triangular, quadrangular, polygonal, and shape including at least one curved face.

28. Package according to claim 1, said beveled edge wall being strengthened by its cross-sectional shape.

29. Package according to claim 1, said beveled edge wall guiding the lid into the shell during closing.

* * * * *